US010011943B2

(12) United States Patent
Chen et al.

(10) Patent No.: US 10,011,943 B2
(45) Date of Patent: Jul. 3, 2018

(54) CONTROL ELEMENT

(71) Applicant: KONINKLIJKE PHILIPS N.V., Eindhoven (NL)

(72) Inventors: Sen Kee Chen, Eindhoven (NL); Jonathan Goh, Eindhoven (NL); Siew Hon Loke, Eindhoven (NL); Yini Sun, Eindhoven (NL); Sonny Lim, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/027,441

(22) PCT Filed: Sep. 25, 2014

(86) PCT No.: PCT/EP2014/070466

§ 371 (c)(1),
(2) Date: Apr. 6, 2016

(87) PCT Pub. No.: WO2015/052007

PCT Pub. Date: Apr. 16, 2015

(65) Prior Publication Data

US 2016/0251796 A1 Sep. 1, 2016

(30) Foreign Application Priority Data

Oct. 7, 2013 (EP) ..... 13187470

(51) Int. Cl.
*D06F 75/26* (2006.01)
*H01H 9/18* (2006.01)
*H01H 19/02* (2006.01)
*D06F 39/00* (2006.01)

(52) U.S. Cl.
CPC ..... *D06F 75/265* (2013.01); *D06F 39/005* (2013.01); *D06F 75/26* (2013.01); *H01H 9/18* (2013.01); *H01H 19/02* (2013.01); *H01H 2231/012* (2013.01)

(58) Field of Classification Search
CPC ..... D06F 75/26; D06F 75/265; D06F 39/00; D06F 39/005; H01H 9/18; H01H 9/02; H01H 2009/187; H01H 2231/012
See application file for complete search history.

(56) References Cited

U.S. PATENT DOCUMENTS 3,238,968 A * 3/1966 Pecis ..... F16K 11/078 116/277
3,720,800 A 3/1973 Arnold
(Continued)

FOREIGN PATENT DOCUMENTS

| | | | |
|---|---|---|---|
| EP | 0853269 | A1 | 7/1998 |
| GB | 1130578 | A | 10/1968 |
| WO | 0071803 | A1 | 11/2000 |

*Primary Examiner* — Ismael Izaguirre

(57) ABSTRACT

This invention relates to a control element, for example a control element for a temperature controller and/or steam controller. The control element has a dial (11) with an opening (18) and a graphic plate (12) is located behind the dial (11). The graphic plate has a marking (19) which is at least partially aligned with the opening so that it is visible therethrough when the dial (11) is rotated relative to the graphic plate (12) within a first angular range.

9 Claims, 6 Drawing Sheets

(56) References Cited

U.S. PATENT DOCUMENTS

| | | | | |
|---|---|---|---|---|
| 5,223,822 | A * | 6/1993 | Stommes | F16K 37/0008 116/277 |
| 7,028,927 | B2 * | 4/2006 | Mermet | A61M 5/16881 137/556 |
| 7,624,749 | B2 * | 12/2009 | Guala | A61M 5/16813 116/277 |
| 2004/0140444 | A1 * | 7/2004 | Beck | A61M 5/16877 251/142 |

* cited by examiner

CONTROL ELEMENT

This application is the U.S. National Phase application under 35 U.S.C. § 371 of International Application No. PCT/EP2014/070466, filed on Sep. 25, 2014, which claims the benefit of International Application No. 13187470.3 filed on Oct. 7, 2013. These applications are hereby incorporated by reference herein.

FIELD OF THE INVENTION

The invention relates to a control element, for example a control element for a temperature controller and/or a steam controller.

BACKGROUND OF THE INVENTION

Steam irons typically have a temperature controller, such as a thermostat, which includes a control element that allows a user to set the operating temperature of the steam iron. A steam iron may have a thermostat which includes a low temperature range in which steam is not produced by the steam iron and a high temperature range in which steam is produced. As the temperature is further increased, the amount of steam that can be produced by the steam iron is also increased. The control element may be provided with several indicative markings that inform a user of the characteristics of the steam iron when the dial is set to a particular position. For example, the amount of steam produced at a particular setting may be indicated by markings on, or adjacent to, the control element.

SUMMARY OF THE INVENTION

It is an object of the invention to provide a control element which substantially alleviates or overcomes the problems mentioned above.

The invention is defined by the independent claims. The dependent claims define advantageous embodiments.

According to a first aspect of the present invention, there is provided a control element comprising a dial having an opening and a graphic plate located behind the dial, the graphic plate having a marking which is at least partially aligned with the opening so that it is visible therethrough when the dial is rotated relative to the graphic plate within a first angular range.

Therefore, the opening and the marking can combine to form an indicator during rotation of the dial within the first angular range. That is, the amount of the marking visible through the window can inform a user of a characteristic associated with the position of the control element. For example, the opening and marking may be used to indicate that the control element is positioned within an operating range (corresponding to the first angular range of the dial) which is associated with a particular characteristic, for example the operating temperature of a device. The marking and opening form a simple and effective indicator that can quickly and simply be interpreted by a user.

The graphic plate may be rotatably mounted and the control element may comprise engagement means operable to cause the dial and the graphic plate to cooperate so that they rotate together when the dial is rotated within a second angular range, thereby preventing alignment of the marking on the graphic plate with the opening in the second angular range so that the marking is not visible through the opening in the second angular range. In this way, the engagement means can be arranged so that the position of the graphic plate is changed to prevent alignment between the marking and the opening in rotational positions in which the alignment is not required or may be misleading. At the same time, the opening and the marking have the appropriate size and position so that they are aligned when the dial is within the first angular range and alignment is desired to form the indicator described above. The rotational movement of the graphic plate caused by the engagement means prevents inaccurate and undesired alignment between the opening and the marking.

The engagement means may comprise a protrusion and a catch, the protrusion being arranged to abut the catch when the dial is within the second angular range so that the graphic plate rotates together with the dial. Therefore, as the dial is rotated into the second angular range the protrusion will abut the catch and rotate the graphic plate together with the dial, preventing alignment between the opening and the marking. Meanwhile, during rotation outside of the second angular range the protrusion and catch are not engaged so that the graphic plate can rotate independently of the dial.

In one example, the protrusion extends from the dial and the catch is formed on the graphic plate.

The engagement means may be operable to rotate the graphic plate between a home position, which is a position occupied by the graphic plate when the dial is rotated within the first angular range, and an end position during rotation of the dial within the second angular range.

The control element may comprise biasing means to bias the graphic plate towards the home position. In this way, when the dial is outside of the second angular range, and the engagement means is not engaged, the graphic plate will return to the home position. Moreover, during rotation of the dial within the second angular range the biasing means may act against the engagement means to keep the catch and protrusion in contact and thereby define the position of the graphic plate.

The biasing means may comprise an inclined cam surface and a resilient member arranged to push against the inclined cam surface.

The inclined cam surface can be arranged such that the biasing means acts in an opposite direction to the engagement means, so that during rotation of the dial within the second angular range the biasing means acts against the engagement means. As the graphic plate is rotated the inclined cam surface will compress the resilient member which provides an opposing force. Therefore, when the engagement means is disengaged from the graphic plate the resultant force on the graphic plate, caused by the resilient member pushing against the inclined cam surface, will cause the graphic plate to rotate towards the home position.

The control element may further comprise a second engagement means operable to engage the graphic plate when the graphic plate is in the home position and when the graphic plate has been rotated to the end position. Therefore, the second engagement means provides limits to the rotation of the graphic plate. The graphic plate is only able to rotate between the home position and the end position and this defines the second angular range.

The second engagement means may comprise a recess in the graphic plate and a fixed pin that extends into the recess, the pin engaging with a first end of the recess when the graphic plate is rotated to the home position and a second end of the recess when the graphic plate is rotated to the end position. Therefore, the separation between the first and second ends of the recess defines the second angular range in which the graphic plate is able to rotate together with the dial. The first and second ends of the recess will move and engage with the pin at the limits of the rotation of the graphic plate.

According to a second aspect of the invention, there is provided a temperature controller comprising the control element described above. The temperature controller may be a thermostat.

According to a third aspect of the invention, there is provided a steam controller comprising the control element described above.

According to a further aspect of the invention, there is provided a device comprising the temperature controller and/or the steam controller described above. According to another aspect of the invention, there is provided a steam iron comprising the temperature controller and/or the steam controller described above.

Therefore, the position of the dial may determine the operating temperature and/or the amount of steam being produced in a device, such as a steam iron. The position of the dial can directly control the temperature controller and/or the steam controller so that the user can accurately control the device and the window and the marking form an indicator to inform the user of the operating temperature and/or the amount of steam being generated by the device when the dial is in that position.

These and other aspects of the invention will be apparent from and elucidated with reference to the embodiments described hereinafter.

BRIEF DESCRIPTION OF THE DRAWINGS

Embodiments will now be described, by way of example only, with reference to the accompanying drawings, in which.

DETAILED DESCRIPTION OF THE EMBODIMENTS

A thermostat for a steam iron has a spindle which is connected to a control element, such as a rotatable dial. Rotation of the dial sets the temperature of a soleplate of the steam iron, for example by controlling the power supplied to the heater or some other variable. In some steam irons, the temperature of the soleplate determines the amount of steam that can be produced without water leakage from the soleplate. Steam is not produced until the temperature of the thermostat is set at a certain temperature (e.g. 100 degrees Celsius) and the soleplate has reached that temperature. Beyond that temperature the rate at which steam is produced, and the pressure of the steam in the steam iron, can be increased as the temperature is increased. In other examples, the control element may be directly connected to a steam controller such that rotation of the dial directly controls the amount of steam that is produced by the steam iron. In one example, the control element may be connected to both a temperature controller and a steam controller, so that rotation of the control dial sets the operating temperature and steam rate of the steam iron. In another example, the control element may be connected to a simple temperature controller, for example the control element may directly control the current supplied to a heater.

Figure 1:
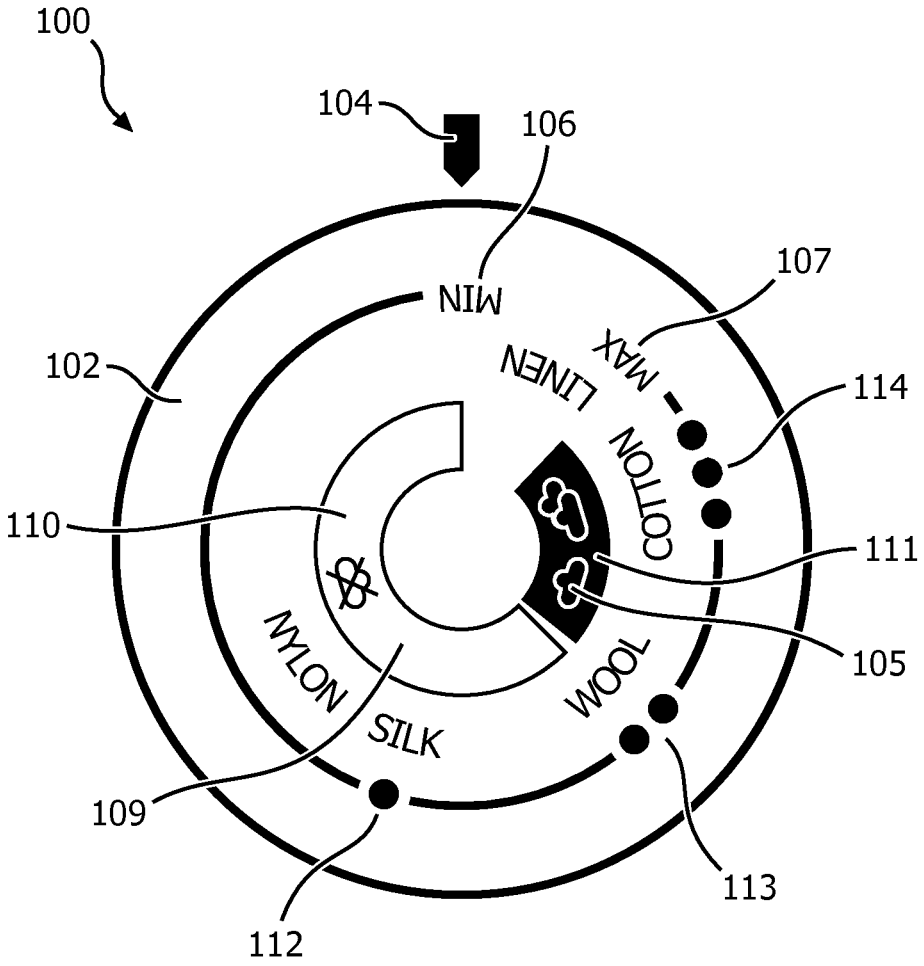
FIG. 1 shows a control element for a temperature controller.

FIG. 1 shows an example control element 100 for a steam iron. The control element 100 is attached to both a temperature controller and a steam controller so that rotation of a dial 102 of the control element 100 controls the temperature of the soleplate and the amount of steam produced by the steam iron.

As shown, the dial 102 has labels on an outer surface and a pointer 104 disposed adjacent to the dial 102 which indicates different positions of the dial 102. The labels on the dial 102 relate to both the temperature of the soleplate and the amount of steam being generated, as explained below.

The dial 102 can be rotated between a minimum position and a maximum position, which are indicated by the pointer 104 being aligned with the minimum and maximum labels 106, 107 shown on the dial 102. When the minimum label 106 is aligned with the pointer 104 the control element is in a minimum position and the temperature of the soleplate is at a minimum (or zero) value. When the maximum label 107 is aligned with the pointer 104 the control element is in a maximum position and the soleplate will be heated to its maximum operational temperature. Any rotational position which is intermediate of the minimum and maximum labels 106, 107 results in some intermediate soleplate temperature. The dial also includes labels that indicate the appropriate temperature setting for different materials that are being ironed. As shown in FIG. 1, the dial 102 includes a one-dot label 112, a two-dot label 113 and a three-dot label 114 that correspond with soleplate temperatures suitable for silk, wool and cotton/linen respectively. The 'dot markings' are widely recognized in the industry and are commonly printed on clothing labels. It will be appreciated that, due to the dial 102 being connected to a controller, from the minimum position shown in FIG. 1 the dial 102 can only be rotated in one direction, in this example a clockwise direction. Similarly, when the dial 102 is set to the maximum position, the dial 102 can only be rotated in an anti-clockwise direction. In other words, the dial 102 can only be rotated in the larger angular region between the minimum and maximum positions, and cannot be rotated into the smaller angular region.

In the example shown in FIG. 1, the dial 102 also includes markings 109 that indicate the amount of steam being produced by the steam iron. The markings 109 are formed of an arcuate band which includes a no-steam region 110 and a steam region 111. When the dial 102 is rotated such that the no-steam region 110 is aligned with the pointer 104 the steam iron will not produce steam, and when the dial 102 is rotated such that the steam region 111 is aligned with the pointer 104 the steam iron will produce steam. As the dial 102 is rotated towards the maximum label 107 within the steam region 111 an increasing amount of steam will be produced. An intermediate steam position is defined where the join between the no-steam region 110 and the steam region 111 is aligned with the pointer 104. The join in the steam markings 109 can be considered an intermediate steam label 105 and this position defines the change from no-steam to steam as the dial 102 is rotated towards the maximum label 107.

Any rotation of the dial between the minimum position and the intermediate steam position indicates to the user that steam should not be generated, and any rotation beyond the intermediate steam position indicates to the user that an increasing amount of steam can be generated up until the pointer 104 is aligned with the maximum label 107.

In the example shown in FIG. 1, the two-dot label 113, which corresponds to an appropriate soleplate temperature for woolen fabrics, is aligned with the intermediate steam label 105. However, this alignment is optional and the two-dot label 113 may be positioned elsewhere on the dial 102, depending on the arrangement of the temperature and steam controllers being controlled by the control element 100.

However, the labels and markings 105, 106, 107, 109, 110, 111, 112, 113, 114 on a dial 102, such as that shown in FIG. 1, are unclear and it is difficult for a user to quickly and accurately determine the amount of heat and/or steam that will, or should, be produced when the dial 102 is in a particular position. This is an important consideration when using the steam iron as excess heat or steam can cause damage to some fabrics. Therefore, it is desirable to provide a control element that more clearly and accurately displays the amount of heat and steam that may be produced when the dial is rotated to particular positions.

Figure 2A:
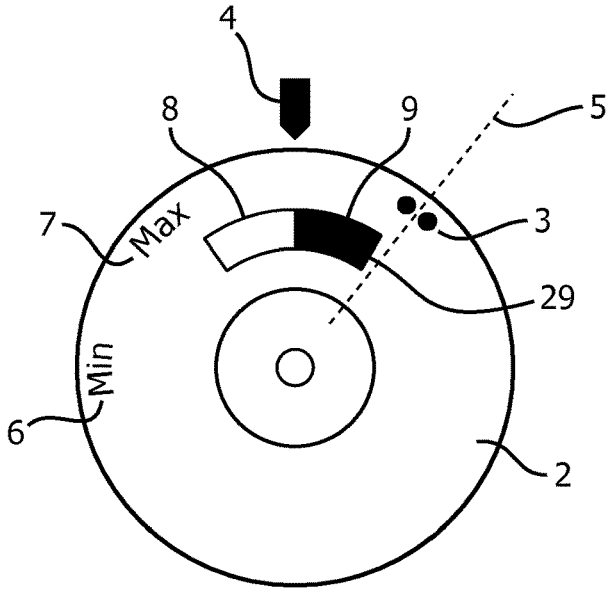
FIG. 2*a* shows a control element of a first embodiment of the invention, the control element having a window and a marking that form an indicator according to the invention.

FIG. 2*a* shows a first embodiment of the invention. In particular, FIG. 2*a* shows a dial 2 that includes a window 8 through which one or more markings 9 can be viewed as the dial 2 is rotated into different positions. In this example, the window 8 is configured to allow a user to view a marking 9 on a surface behind the dial 2 and the marking 9 and window 8 are configured such that the amount of the window 8 occupied by the marking 9 informs the user of the amount of steam that will be produced at that particular dial position. The marking 9 behind the dial 8 may be provided on a graphic plate or surface (not shown in FIG. 2*a*) positioned behind the dial 2.

Similarly to the example described with reference to FIG. 1, the dial 2 has minimum and maximum labels 6,7 that indicate minimum and maximum positions of the dial 2, and also an intermediate temperature label 3, represented by the two-dot label. An intermediate steam position may be indicated by an intermediate steam label 5 which, in this example, is aligned with the intermediate temperature label 3. For the purposes of clarity in the drawings, the intermediate steam label 5 is shown as a line. However, as will become apparent hereinafter, when the dial 2 is rotated such that the pointer 4 is aligned with a first end 29 of the window 8, the dial is aligned with the intermediate steam position and therefore the intermediate steam label 5 on the dial 2 is optional. It will be appreciated that, due to the dial 2 being connected to a controller, from the minimum position the dial 2 can only be rotated in one direction, in this example a clockwise direction. Similarly, when the dial 2 is set to the maximum position, the dial 2 can only be rotated in an anti-clockwise direction. In other words, the dial 2 can only be rotated in the larger angular region between the minimum and maximum positions, and cannot be rotated into the smaller angular region. When the dial 2 is rotated so that the pointer 4 is aligned to the intermediate steam label 5 the beginning of the marking 9 will be visible at one end of the window 8. As the dial 2 is rotated towards the maximum position more of the marking 9 will be visible in the window 8 until the marking 9 occupies the entire window 8 when the maximum label 7 is aligned with the pointer 4, indicating maximum steam rate for the device.

Therefore, the marking 9 and the window 8 combine to provide an indicator that informs the user of the amount of steam that the steam iron will produce at that particular position of the dial 2. A user is quickly and easily able to view how much of the window 8 is occupied by the marking 9 and thereby infer how much steam is going to be produced. The user does not need to ascertain which part of the marking 9 is aligned with the indicator 4 in order to determine how much steam will be produced as the proportion of the window 8 occupied by the marking 9 quickly communicates this information to the user.

In the example shown in FIG. 2*a* the dial 2 is set to a position where the pointer 4 is between the intermediate steam label 5 and the maximum label 7 so that roughly half of the window 8 is occupied by the marking 9 on the surface behind the dial 2. Therefore, the user is quickly and easily informed that the steam iron is operating at roughly half of the maximum steam rate.

In the example shown in FIG. 2*a* the marking 9 comprises a single band of color that is aligned with the window 8 during a part of the rotation of the dial 2 the first angular range. However, it will be appreciated that the marking 9 may comprise one or more shapes or symbols that can be aligned with the window 8, and the window 8 may comprise one or more openings that allow the marking 9 to be visible through the dial 2 when the dial 2 is rotated within the first angular range. Alternatively, the marking 9 may comprise different shades of color. In this example, the first angular range extends between the intermediate steam position (indicated by the pointer 4 being aligned with the intermediate steam label 5) and the maximum position (indicated by the pointer 4 being aligned with the maximum label 7) of the dial 2.

It is preferable to maximize the amount of the rotation of the dial 2 so that the size of the marking 9 and window 8 can be increased, making the information provided by the marking 9 and the window 8 quicker and easier for a user to interpret. Moreover, increasing the amount of rotation of the dial 2 gives the user more accurate control over the temperature of the soleplate and the amount of steam being produced by the device.

Figure 2B:
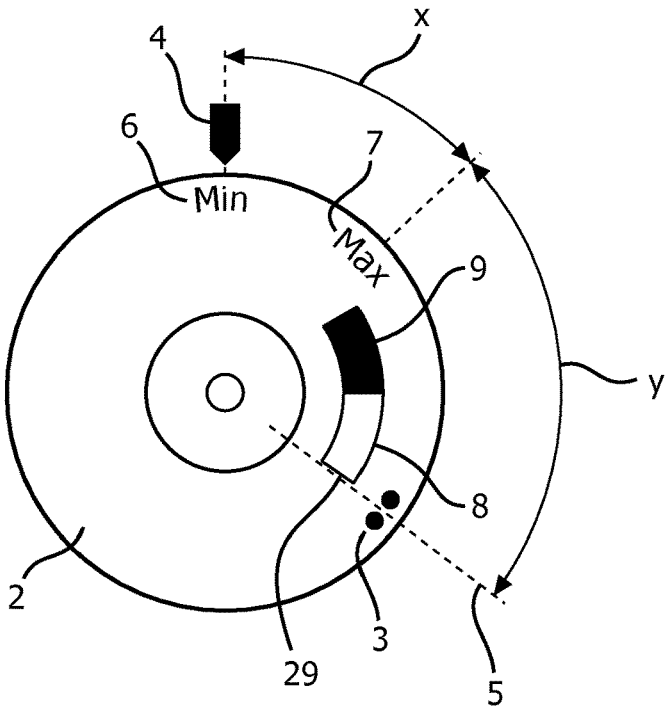
FIG. 2*b* shows the control element of FIG. 2*a* rotated to a minimum position.

However, as shown in FIG. 2*b*, if the angular separation between the intermediate steam position (indicated by intermediate steam label 5) and the maximum position (indicated by maximum label 7) is increased, and if the size of the window 8 and marking 9 are increased accordingly, then the marking 9 may also be partially visible in the window 8 when the dial 2 is set to the minimum position (indicated by the minimum label 6). It is preferable to avoid this situation as this may be misleading and can cause confusion among users.

As shown in FIG. 2*b*, in this example, the angle X, between the minimum label 6 and the maximum label 7 (short direction), is less than the angle Y, between the maximum label 7 and the intermediate steam label 5. This arrangement results in the problem described above, where the marking 9 behind the dial 2 is visible through the window 8 when the dial 2 is in the minimum position, or close to it. To avoid this, angle X can be increased until it is greater than angle Y, but this is less desirable because it would require a re-design of the controller being controlled by rotation of the dial 2. Moreover, it is preferable to provide the dial 2, and the controller, with as much rotational movement as possible (between the minimum and maximum positions) so that the user is able to more accurately control the temperature and/or steam rate of the device. Also, this increased rotational distance means that the window 8 and the marking 9 are larger and provide the user with more accurate and interpretable information on the amount of steam being produced.

Figure 3:
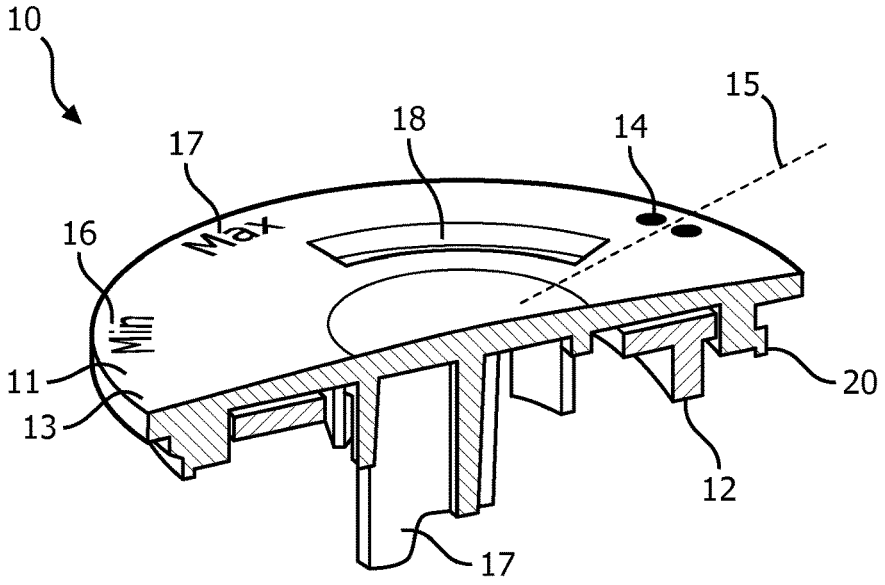
FIG. 3 shows a cut-away view of a control element of a second embodiment according to the invention.

A further embodiment of the invention is shown in FIGS. 3 to 6*c*. In particular, FIG. 3 shows a perspective cut-away view of a control element 10 for a temperature and steam controller of a steam iron, the control element 10 having a dial 11 and a graphic plate 12. As shown, the dial 11 comprises a circular upper part 13 which is visible on the device and which a user can grip to rotate the dial 11. The upper part 13 has maximum, minimum and intermediate temperature labels 17, 16, 14 that, together with an adjacent pointer (not shown in FIG. 3), allow a user to control the soleplate temperature by rotating the dial 11. The labels 17, 16, 14, when aligned with a pointer adjacent to the dial 2, indicate three positions of the dial 11 and the controller: a maximum position, a minimum position and an intermediate temperature position, respectively. The control element 10 shown in FIG. 3 also comprises a spindle 17 which extends from the dial 11 and is attached to a controller (not shown) to alter a temperature and/or steam characteristic of the steam iron as the dial 11 is rotated. It will be appreciated that, due to the dial 11 being connected to a controller, from the minimum position the dial 11 can only be rotated in one direction, in this example a clockwise direction. Similarly, when the dial 11 is set to the maximum position, the dial 11 can only be rotated in an anti-clockwise direction. In other words, the dial 11 can only be rotated in the larger angular region between the minimum and maximum positions, and cannot be rotated into the smaller angular region.

Also shown in FIG. 3, similarly to the dial described with reference to FIG. 2*a*, the control element 10 has an intermediate steam position which indicates at which point the steam iron may begin to generate steam as the dial 11 is rotated towards the maximum label 17. For purposes of clarity, the intermediate steam position is indicated by intermediate steam label 15, although it will be appreciated that the intermediate steam label 15 is optional and provided for the purpose of clarity.

As shown in FIG. 3, the dial 11 also has a window 18 which is formed in an arcuate shape in the upper part 13 of the dial 11. The window 18 is provided so that one or more markings (not shown in FIG. 3) on the graphic plate 12 are visible through the window 18 during a first angular range of the rotation of the dial 11, in the same way as the embodiment described with reference to FIG. 2*a*.

In this example, the window 18 has an arcuate shape and extends around the dial 11 between the intermediate steam label 15 and the maximum label 17. However, it will be appreciated that the window 18 may be formed by any shape opening, or several openings, in the dial 11 that allows a user to view the graphic plate 12 disposed behind the dial 11. Furthermore, the window 18 may extend to the circumferential edge of the dial 11.

When the dial 11 is rotated to the intermediate steam position the pointer (not shown in FIG. 3) will be approximately aligned with an end of the window 18 and an end of the marking (not shown in FIG. 3) on the graphic plate 12 will be visible in the window 18. Therefore, an additional intermediate steam label 15 is not essential.

The graphic plate 12 is rotatably mounted to the spindle or to the dial such that it can rotate independently of the dial 11, within the limits defined by the engagement means and biasing means described hereinafter with reference to FIGS. 4*a* to 6*c*. The graphic plate 12 is rotatably mounted to either the spindle 17 or a spigot of the dial 11 or, as shown in FIG. 3, the graphic plate 11 may be received within a cylindrical wall 20 that extends from the dial 11 and surrounds the graphic plate 12.

Figure 4A:
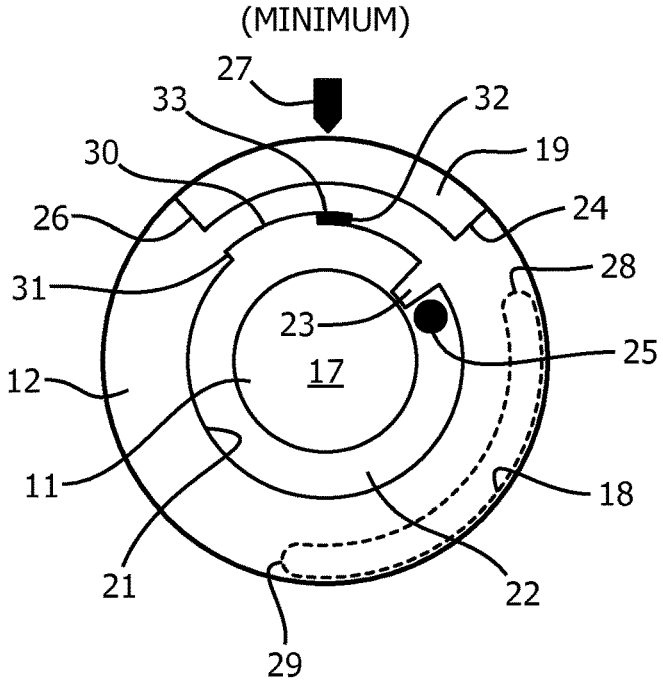
FIG. 4*a* shows a schematic view of the control element of FIG. 3, in a minimum position.
Figure 4B:
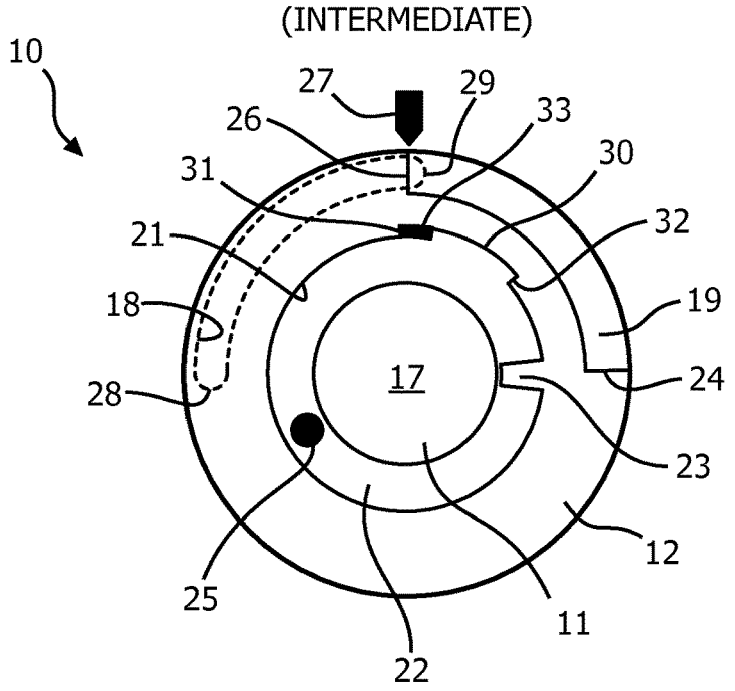
FIG. 4*b* shows a schematic view of the control element of FIG. 3, in an intermediate position.
Figure 4C:
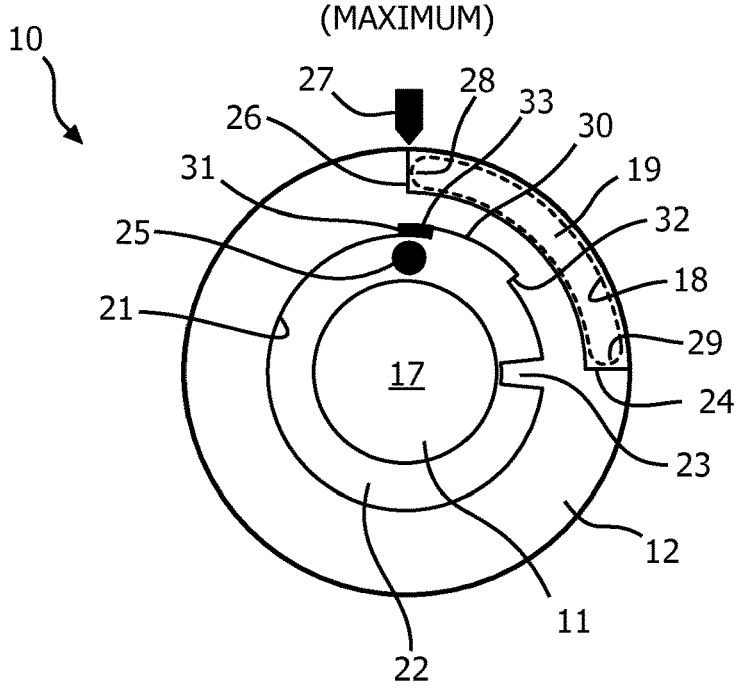
FIG. 4*c* shows a schematic view of the control element of FIG. 3, in a maximum position.

FIGS. 4*a* to 4*c* show schematic drawings of the control element 10 of FIG. 3 in the minimum, intermediate steam, and maximum positions indicated by the labels (16, 15, 17, see FIG. 3) on the dial 11. The schematic drawings are looking from above the control element 10, from the top side of the dial 11, and each of FIGS. 4*a*, 4*b* and 4*c* show the graphic plate 12 and the spindle 17 and features of the dial 11, although, for purposes of clarity, the upper part (13, see FIG. 3) of the dial 11 is not shown.

As shown in FIGS. 4*a* to 4*c*, the graphic plate 12 comprises a bore 21 and an annular gap 22 is formed between the bore 21 of the graphic plate 12 and the spindle 17 of the dial 11. A catch 23 extends from the edge of the bore 21 of the graphic plate 12 into the annular gap 22 in a position which is approximately aligned with a first end 24 of the marking 19 on the graphic plate 12. A protrusion 25 extends from the dial 11 into the annular gap 22 and is configured to engage with the catch 23 when the dial 11 is rotated towards the minimum position shown in FIG. 4*a*. The catch 23 and the protrusion 25 form a first engagement means.

The graphic plate 12 also comprises a biasing means (not shown in FIGS. 4*a* to 4*c*), which will be described with reference to FIGS. 5*a* and 5*b*, that acts to bias the rotation of the graphic plate 12 towards a home position in which the graphic plate 12 is in position to indicate the level of steam that will be produced once the dial 11 is rotated beyond the intermediate steam position (indicated by intermediate steam label 15 shown in FIG. 3) towards the maximum position. This home position of the graphic plate 12 is shown in FIGS. 4*b* and 4*c*. In the home position, the second end 26 of the marking 19 on the graphic plate 12 is aligned with the pointer 27, such that when the dial 12 is in the intermediate steam position (indicated by intermediate steam label 15 shown in FIG. 3) the second end 29 of the window 18 is aligned with the pointer 27 and the second end 26 of marking 19 will begin to be visible through the window 18. FIGS. 4*a* to 4*c* also show the window 18 in the dial 11 and it can be seen that a first end 28 of the window 18 is proximate to the protrusion 25 of the dial 11, with the window 18 extending towards a second end 29 in an arcuate shape. In particular, in this example, the window 18 extends between the intermediate steam label (15, see FIG. 3) and the maximum label (17, see FIG. 3) on the dial 11.

FIG. 4*a* shows the control element 10 when the dial 11 is in the minimum position, as indicated by the minimum label (16, see FIG. 3) being aligned with the pointer 27. As shown in FIG. 4*a*, in this position the protrusion 25 of the dial 11 has pushed the graphic plate 12 such that it has rotated to avoid alignment between the marking 19 and window 18, overcoming the previously described situation of misleading alignment between the window 18 and the marking 19. In this example, the protrusion 25 would have engaged the catch 23 as the dial 11 was rotated in an anti-clockwise direction towards the minimum position.

Also shown in FIG. 4*a*, the control element 10 comprises a second engagement means that limits the extent of rotation of the graphic plate 12. As shown, the bore 21 of the graphic plate 12 comprises a recess 30 that extends in a circumferential direction around the bore 21 such that first and second ends 31, 32 of the recess are formed with an angular separation. In this example, the first end 31 of the recess 30 is proximately aligned with the second end 26 of the marking 19, with the recess 30 extending around the graphic plate 12 in the same direction as the marking 19.

A pin 33 extends into the recess 30 and the pin 33 is attached to, or extends from, a rotatably fixed part of the control element 10. For example, the pin 33 may extend from the housing surrounding the control element 10. Therefore, the position of the pin 33 is fixed. The first end 31 of the recess 30 defines the maximum extent of rotation of the graphic plate 12 in one direction, in this case a clockwise direction, as shown in FIGS. 4*b* and 4*c*. The previously mentioned biasing means, described hereinafter with reference to FIGS. 5*a* and 5*b*, pushes the graphic plate 12 into a position where the pin 33 engages the first end 31 of the recess 30. This is the home position of the graphic plate 12—the position the graphic plate 12 will return to when the protrusion 25 is not engaged with the catch 23 to displace the graphic plate 12.

In an alternative embodiment, the recess 30 may be formed by a pair of spaced protrusions (not shown) on the edge of the bore 21 of the graphic plate 12. In this way, the pin 33 will move between the protrusions, which define the rotational freedom of the graphic plate 12. In an alternative embodiment, the recess 30 may be formed on a fixed part of the control element 10 or device and the pin 33 may extend from the graphic plate 12.

The second end 32 of the recess defines the maximum extent of rotation of the graphic plate 12 and the dial 11 in the second direction, in this example an anti-clockwise direction, when the protrusion 25 of the dial 11 has pushed the graphic plate 12 to rotate into the position shown in FIG. 4*a*—the minimum position (indicated by label 16, see FIG. 3). Furthermore, the engagement between the pin 33 and the second end 32 of the recess, in the position shown in FIG. 4*a*, also limits the rotation of the dial 11 in this direction.

When the dial 11 is rotated in a clockwise direction towards the maximum position (indicated by maximum label 17, see FIG. 3) the control element 10 will reach the intermediate steam position (indicated by intermediate steam label 15 shown in FIG. 3) and at that point the second end 26 of the marking 19 on the graphic plate 12 will begin to be visible in the second end 29 of the window 18, as shown in FIG. 4*b*. In this position, the biasing means has rotated the graphic plate 12 back to the home position, such that the pin 33 has engaged the first end 31 of the recess 30 and the second end 26 of the marking 19 is aligned with the pointer 27.

FIG. 4*c* shows the control element 10 in the maximum position, as indicated by the maximum label (17, see FIG. 3) being aligned with the pointer 27. As shown in FIG. 4*c*, when the dial 11 is rotated further than the intermediate steam position (shown in FIG. 4*b*), clockwise towards the maximum position, the marking 19 will occupy more of the window 18 until the maximum position is reached, at which point the window 18 and marking 19 are fully aligned, as shown in FIG. 4*c*.

Therefore, the window 18 and marking 19 are only (at least partially) aligned when the dial 11 is rotated between the intermediate steam position (shown in FIG. 4*b*) and the maximum position (shown in FIG. 4*c*). Then, as the dial 11 is rotated in an anti-clockwise direction towards the minimum position (shown in FIG. 4*a*) the first engagement means (protrusion 25 and catch 23) causes the graphic plate 12 to rotate with the dial 11, preventing misleading alignment between the marking 19 and the window 18 when the dial 11 is set proximate to the minimum position, as described with reference to FIG. 2*b*.

It will be appreciated that, in some embodiments, the clockwise and anti-clockwise rotational directions described above may be reversed.

Figure 5A:
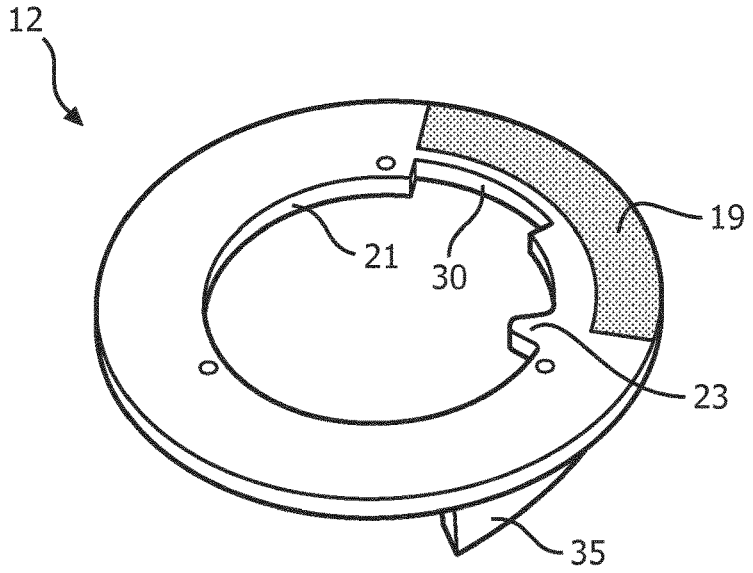
FIG. 5*a* shows a top perspective view of the graphic plate of the control element of FIGS. 3 to 4*c;*
Figure 5B:
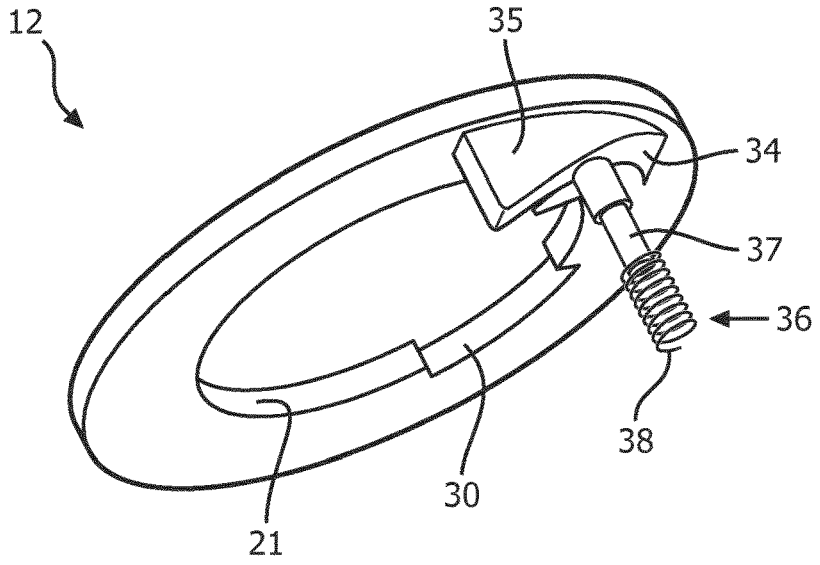
FIG. 5*b* shows a bottom perspective view of the graphic plate of the control element of FIGS. 3 to 4*c;*

FIGS. 5*a* and 5*b* show the graphic plate 12 in more detail. As described with reference to FIGS. 4*a* to 4*c*, and shown in FIGS. 5*a* and 5*b*, the graphic plate 12 comprises a bore 21 which includes a catch 23 that, together with a protrusion (25, see FIGS. 4*a* to 4*c*) of the dial (11, see FIGS. 4*a* to 4*c*) forms a first engagement means for rotating the graphic plate 12 when the dial (11, see FIGS. 4*a* to 4*c*) is rotated towards the minimum position (shown in FIG. 4*a*). The recess 30 of the graphic plate 12 is also shown in FIGS. 5*a* and 5*b*. As previously described, the recess 30 is formed on the edge of the bore 21 and engages with a fixed pin (33, see FIGS. 4*a* to 4*c*) to define the rotational freedom of the graphic plate 12 the graphic plate 12 can only be rotated by the angle defined by the recess 30.

Also shown in FIGS. 5*a* and 5*b*, the graphic plate 12 comprises a biasing means that urges the graphic plate 12 to rotate towards the home position shown in FIGS. 4*b* and 4*c*. The biasing means acts against the force of the protrusion (25, see FIGS. 4*a* to 4*c*) of the dial (11, see FIGS. 4*a* to 4*c*) which pushes against the catch 23 on the graphic plate 12. The biasing means comprises an inclined cam surface 34 formed by a ramp shaped cam member 35 that extends from one side of the graphic plate 12 in an axial direction relative to the rotational axis of the graphic plate 12. As shown in FIG. 5*b*, a resilient member 36 is disposed to engage with, and push against, the inclined cam surface 34. In this example, the inclined cam surface 34 of the cam member 35 is inclined such that the distance between the graphic plate 12 and the inclined cam surface 34 increases in one direction around the graphic plate 12, such that when the graphic plate 12 is rotated the resilient member 36 is compressed and provides a rotational force in the opposite direction to oppose the displacement of the graphic plate 12 from the home position shown in FIGS. 4*b* and 4*c*.

The resilient member 36 of the biasing means comprises a pusher 37 and a spring 38 disposed between the pusher 37 and a fixed part of the device, for example a part of the housing of the device. The spring 38 and pusher 37 may be disposed in a fixed recess (not shown) in the housing so that the position of the resilient member 36 (including the spring 38 and the pusher 37) is fixed and does not rotate with the graphic plate 12 or dial (11, see FIGS. 4*a* to 4*c*).

In an alternative embodiment, the cam member 35 may be formed on a fixed part of the device and the resilient member 36 may be disposed on the graphic plate 12. In an alternative embodiment, the biasing means may comprise a torsion spring that acts to rotate the graphic plate 12 towards the home position shown in FIGS. 4*b* and 4*c*.

As described with reference to FIGS. 4*a* to 5*c*, the biasing means will push the graphic plate 12 to rotate into the home position shown in FIGS. 4*b* and 4*c*, where the marking 19 is in a position to align with the window 18 when the dial 11 reaches the intermediate steam position shown in FIG. 4*b*. As previously described, as the dial 11 is rotated towards the minimum position shown in FIG. 4*a* the protrusion 25 of the dial 11 engages the catch 23 of the graphic plate 12 and rotates the graphic plate 12 against the force of the biasing means. In this way, the rotational position of graphic plate 12 is changed when the dial 11 is rotated towards the minimum position, to avoid undesired alignment between the window and the indicative marking.

In an alternative embodiment, the first engagement means may be a ratchet mechanism (not shown) mounted in between the dial and the graphic plate that causes the graphic plate to rotate together with the dial when the dial is moved towards the minimum position, to prevent alignment between the window and the marking. Then, as the dial is rotated in the opposite direction, towards the intermediate steam position, the ratchet mechanism disengages and the graphic plate returns to the home position under the force of a biasing means or being pushed by the ratchet mechanism.

Figure 6A:
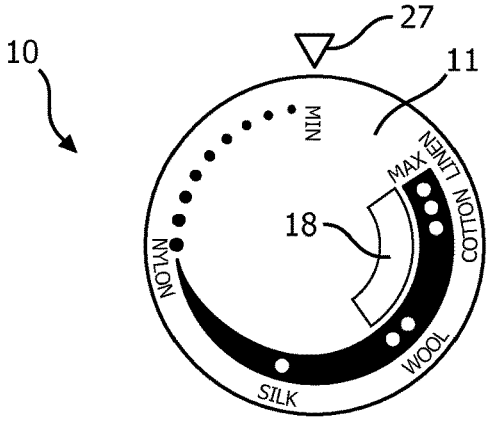
FIG. 6*a* shows the control element of FIGS. 3 to 4*c*, in a minimum position.
Figure 6B:
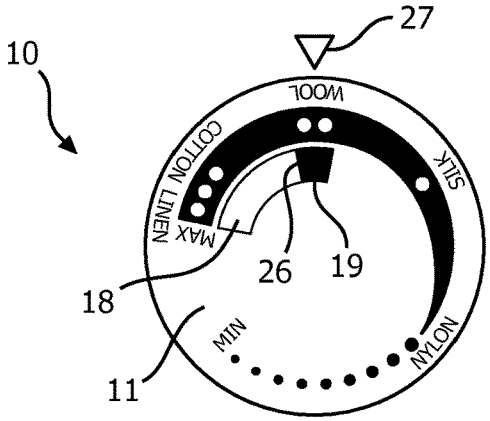
FIG. 6*b* shows the control element of FIGS. 3 to 4*c*, in an intermediate position; and, FIG. 6*c* shows the control element of FIGS. 3 to 4*c* in a maximum position.
Figure 6C:
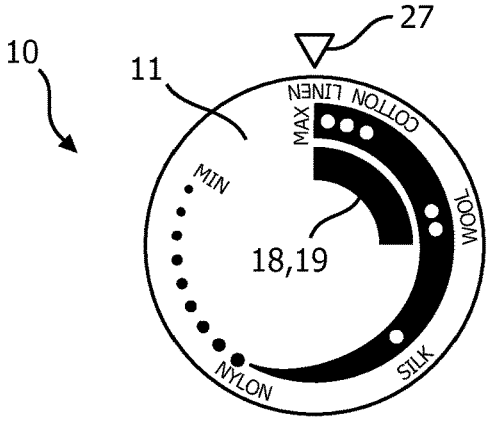

FIGS. 6*a* to 6*c* show the operation of the control element 10 described with reference to FIGS. 3 to 5*b*. FIG. 6*a* shows the control element 10 in the minimum position where the graphic plate 12 has been rotated such that the marking (19, see FIGS. 4*a* to 5*c*) on the graphic plate 12 is not visible through the window 18 in the dial 11. FIG. 6*b* shows the dial 11 in the intermediate steam position and in this position the graphic plate 12 has returned to its home position and the second end 26 of the marking 19 is visible through the window 18 in the dial 11. The rotational position shown in FIG. 6*b* represents the lowest temperature at which steam is produced, so the second end 26 of the marking 19 is partially visible at the second end 29 of the window 18. FIG. 6*c* shows the dial 11 rotated to the maximum position in which the marking 19 on the graphic plate 12 occupies the entire window 18 in the dial 11, indicating that the steam iron is operating at maximum steam rate.

The control element 10 described with reference to FIGS. 3 to 6*c* is configured such that, during rotation between the maximum position (shown in FIGS. 4*c* and 6*c*) and the intermediate steam position (shown in FIGS. 4*b* and 6*b*) the graphic plate 12 is in the home position and the dial 11 rotates independently of the graphic plate 12. Furthermore, when the dial is rotated between the minimum position (shown in FIGS. 4*a* and 6*a*) and a (second) intermediate steam position the protrusion 25 engages the catch 23 and the graphic plate 12 rotates together with the dial 11 such that the marking 19 and the window 18 are not aligned. That is, when the dial 11 is rotated within a first angular range the marking 19 on the graphic plate 12 is aligned with the window 18 and the dial 11 moves independently of the graphic plate 12 and, in a second angular range the first engagement means (protrusion 25 and catch 23) causes the graphic plate 12 to rotate with the dial 11, thereby avoiding undesired alignment between the window 18 and the marking 19. In this example, a third angular range exists in between the first and second angular ranges. When the dial 11 is within this third angular range the engagement means is not engaged, so that the graphic plate 12 does not rotate together with the dial 11, but also the marking 19 and the window 18 are not aligned. It will be appreciated that this third angular range is optional and, depending on the size of the window 18 and marking 19, the first and second angular ranges may be adjacent to each other with no third angular range therebetween.

The control element 10 described with reference to FIGS. 2*a* to 6*c* can be rotated between a maximum temperature position (see FIGS. 4*c* and 6*c*) and a minimum temperature position (see FIGS. 4*a* and 6*a*) which also determines the amount of steam that the steam iron produces, as indicated by the marking and the window. However, it will be appreciated that a similar control element may be used for other controllers, for example a controller for an air conditioning unit or heater. In this case, the marking and the window may combine to indicate some other characteristic, for example temperature and/or humidity and/or operating time and/or pressure. Alternatively, the control element may be used to select an operating condition, for example a control element for a washing machine or laundry dryer. It will also be appreciated that the dial may be provided with any labels appropriate for the control element and the window and marking may indicate a different characteristic to the labels on the dial. In the examples described with reference to FIGS. 2*a* to 6*c*, the control element is used to control both a temperature controller and a steam controller. However, it will be appreciated that the control element may be used to control a single controller, such as steam, temperature, time, humidity etc. In this case, the dial may be provided with fewer labels and markings, as appropriate.

Moreover, the window and marking may be positioned elsewhere around the dial, for example between the minimum position and an intermediate position. The engagement means can also be moved into different positions around the control element and dial, depending on the requirement of the thermostat. In some cases, the first and second engagement means may be configured to engage and rotate the graphic plate as the dial is rotated towards the maximum position. The engagement means may be arranged to engage the graphic plate as the dial is rotated in a clockwise direction or an anti-clockwise direction. The biasing means can also be arranged to oppose either clockwise or anti-clockwise rotation.

It will be appreciated that the term "comprising" does not exclude other elements or steps and that the indefinite article "a" or "an" does not exclude a plurality. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalization thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A control element comprising a dial and a graphic plate located behind the dial, the graphic plate having a marking, wherein the dial has an opening and the marking of the graphic plate is at least partially aligned with the opening so that it is visible therethrough when the dial is rotated relative to the graphic plate within a first angular range, wherein the graphic plate is rotatably mounted and the control element further comprises engagement means operable to cause the dial and the graphic plate to cooperate so that they rotate together when the dial is rotated within a second angular range, thereby preventing alignment of the marking on the graphic plate with the opening in the second angular range so that the marking is not visible through the opening in the second angular range.

2. The control element of claim 1, wherein the engagement means comprises a protrusion and a catch, the protrusion being arranged to abut the catch when the dial is within the second angular range so that the graphic plate rotates together with the dial.

3. The control element of claim 2, wherein the protrusion extends from the dial and the catch is formed on the graphic plate.

4. The control element of claim 1, wherein the engagement means is operable to rotate the graphic plate between a home position, which is a position occupied by the graphic plate when the dial is rotated within the first angular range, and an end position during rotation of the dial within the second angular range.

5. The control element of claim 4, wherein the control element comprises biasing means to bias the graphic plate towards the home position.

6. The control element of claim 5, wherein the biasing means comprises an inclined cam surface and a resilient member arranged to push against the inclined cam surface.

7. The control element of claim 4, further comprising a second engagement means operable to engage the graphic plate when the graphic plate is positioned in the home position and in the end position.

8. The control element of claim 7, wherein the second engagement means comprises a recess in the graphic plate and a pin that extends into the recess, the pin engaging with a first end of the recess when the graphic plate is rotated to the home position and a second end of the recess when the graphic plate is rotated to the end position.

9. A temperature controller comprising the control element of claim 1.

* * * * *